US005449032A

United States Patent [19]

Blevins et al.

[11] Patent Number: 5,449,032

[45] Date of Patent: Sep. 12, 1995

[54] AWNING BOW

[76] Inventors: Timothy D. Blevins; Donald E. Blevins, both of P.O.Box 1088, Rockwall, Tex. 75087

[21] Appl. No.: 229,748

[22] Filed: Apr. 19, 1994

[51] Int. Cl.[6] ..... E04F 10/00

[52] U.S. Cl. ..... 160/80; 160/71

[58] Field of Search ..... 160/80, 22, 67, 65, 160/47, 66, 68, 64, 75, 76; 135/89; 114/361; 248/354.4, 354.5; 296/109, 111, 114, 118, 122

[56] References Cited

U.S. PATENT DOCUMENTS

| | | | |
|---|---|---|---|
| 3,226,066 | 12/1965 | Folb . | |
| 3,612,145 | 10/1971 | Darula et al. | 160/67 |
| 3,834,400 | 9/1974 | Sattler . | |
| 4,075,723 | 2/1978 | Bareis et al. . | |
| 4,640,332 | 2/1987 | Turner | 160/65 X |
| 4,801,119 | 1/1989 | Pelletier . | |
| 5,094,285 | 3/1992 | Murray | 160/67 |
| 5,174,352 | 12/1992 | Murray et al. | 160/67 |
| 5,203,393 | 4/1993 | Blevins et al. . | |
| 5,207,255 | 5/1993 | Shannon | 160/65 |
| 5,253,667 | 10/1993 | Chung . | |

*Primary Examiner*—David M. Purol
*Attorney, Agent, or Firm*—Richard C. Litman

[57] ABSTRACT

An improved adjustable rib for use with an awning support apparatus which in turn is used with an awning having one end attached to a wall and a second end attached to an awning support tube held a predetermined distance from one end of the awning, measured along the awning, by a pair of side frames attached to the wall. The improved adjustable rib includes an elongated rigid bowed housing having two open ends. Elongated and rigid flat bars, having a curvature nearly identical to that of the housing, slide within the housing and are adjustable to vary the length of the rib. Lock screws, which are screwed into a hole in each of the flat bars, are used to fix the position of the flat bars within the housing. In a second embodiment, the rib includes a smaller diameter curved tube which telescopically fits into a larger curved diameter tube having the same curvature as the smaller tube.

6 Claims, 3 Drawing Sheets

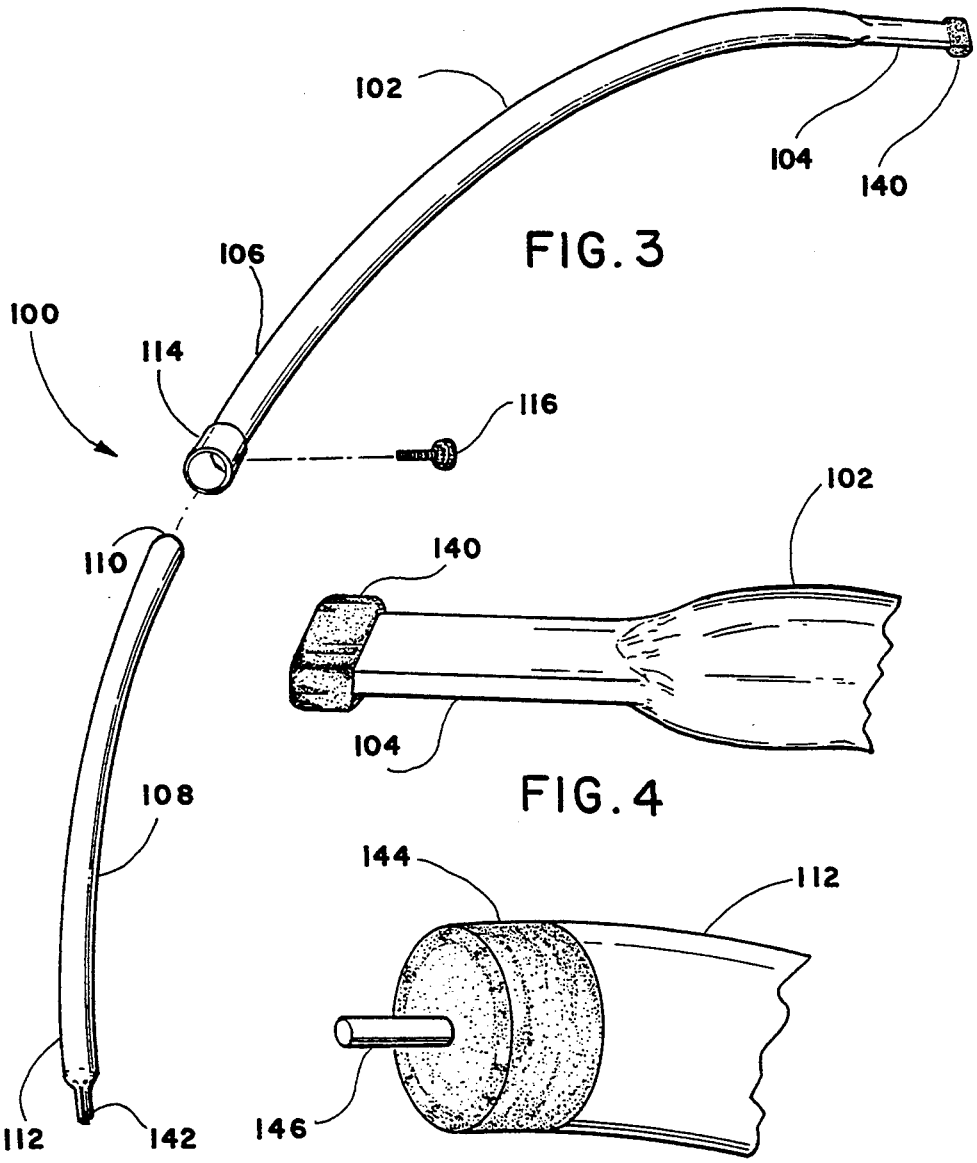
FIG. 3
FIG. 4
FIG. 5
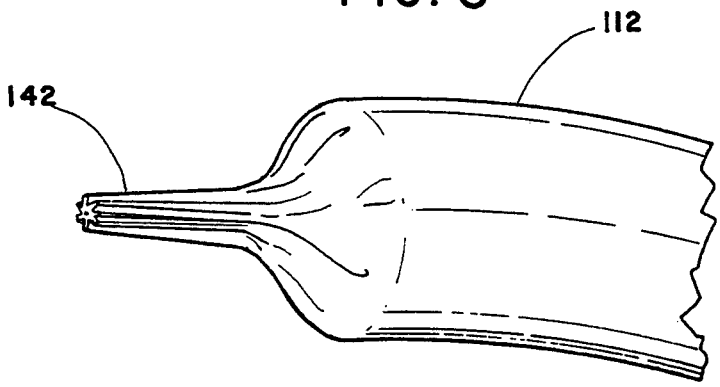
FIG. 6

AWNING BOW

BACKGROUND OF THE INVENTION

1. FIELD OF THE INVENTION

The present invention relates to awnings of fabric or other supple material which are mounted on rigid frames, especially house trailers and recreational vehicles awnings. More particularly, this invention involves the provision of collapsible bowed ribs to support the fabric so as to provide additional stability during windy conditions, provide additional room clearance, and prevent the accumulation of water and debris on the top side of the awning.

2. DESCRIPTION OF THE PRIOR ART

Awnings today are a very common accessory for house trailers and recreational vehicles. Bowed supports have been designed specifically for use with boat covers and for use with tents. However, these designs are not particularly suited for use with house trailers or recreational vehicles. A house trailer or recreational vehicle usually lacks any sort of porch roof or other outside shade, but is much in need of such an overhead cover for rain and sun protection.

This need has led to various designs for stow-away awnings that fit on the side of house trailers or recreational vehicles to provide cover when opened, and also store compactly and securely. The most common design uses a roller tube around which the awning is wrapped when not in use. The deficiencies of these designs were discussed in the earlier patent of the applicant, U.S. Pat. No. 5,203,393, ('393 patent) issued on Apr. 20, 1993.

The '393 patent discloses an awning support system which used plural ribs disposed against the underside of awning. The ribs run transversely from the wall to a tub which supports the awning. These ribs are flexible and acquire an upward bow when put into place.

U.S. Pat. No. 3,226,066, issued to Jacob Folb on Dec. 28, 1965, discloses Bow Sockets for use with a boat cover. The bow sockets, which are applied to the inside face of a boat side rail, have a generally rectangular cross section with a through aperture to receive the ends of a canvas support bow. Also disclosed is the use of an interlocking sleeve for joining the ends of two support bows to form a arched support structure. However, this patent does not disclose a bowed support capable of telescoping adjustment.

U.S. Pat. No. 3,834,400, issued to James L. Sattler on Sep. 10, 1974, discloses an Awning Construction in which an awning fabric is secured to a trailer and supported by a frame which includes a front bar, a pair of side arms at the sides of the front bar, and rafters extending from a vehicle to the front bar. This invention fails to provide for rigid bowed support ribs between the side arms which may be telescopically adjusted to fit various size awnings.

U.S. Pat. No. 4,075,723, issued to Marvin A. Bareis et al. on Feb. 28, 1978, discloses a Boat Cover Means which includes a cover of flexible resilient sheet material and a flexible and resilient rib adapted to extend in arched configuration over a boat.

U.S. Pat. No. 5,253,667, issued to Ching-Poa Chung on Oct. 19, 1993, discloses a Collapsible Tubular Frame for use with tents. The frame of this invention includes a plurality of curved tubes having the same length and curvature but different diameters for shrinking into a largest-diameter curved tube one after another so as to be become very short when being shrunk.

None of the above inventions and patents, taken either singly or in combination, is seen to describe the instant invention as claimed.

SUMMARY OF THE INVENTION

The present invention is an improvement of the applicant's patent for Awning Support Ribs which issued as U.S. Pat. No. 5,203,393 ('393 patent) issued on Apr. 20, 1993. The '393 patent is incorporated herein by reference.

The improved awning support rib of this invention includes a curved elongated housing having a first end, a second end, and a slide element receiving aperture extending therethrough. Two rigid, elongated, and curved slide bars, having the same curvature as the housing, are dimensioned to slide within the aperture of the housing.

In the '393 patent, flexible ribs run transversely from the wall to a tube which supports the awning. The curvature of the ribs in the '393 patent is due to compression resulting from placing the ribs between the wall and the tube. In the present invention, the curvature of the ribs is provided by the rigid bowed housing in conjuction with the rigid bowed slide bars, resulting in increased stability.

The curved sections of flat bars slide within the housing for adjustment of the length of the ribs, and may be retracted within the housing for convenient storage of the rib when not in use. A hole is tapped through each flat bar to allow use of lock screws to fix the length of a rib. A lock screw is threaded through the hole in a section of flat bar until it engages the wall of the housing.

Accordingly, it is a principal object of the invention to provide a improved telescoping awning support rib having a rigid bowed structure to increase the stability of the support.

It is another object of the invention to provide an awning support rib with telescoping slide bars which may be retracted within the rigid bowed housing for convenient storage.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a perspective view of an alternative embodiment.

FIG. 4 is a detail perspective view of the outer cap end with a plastic cap over the end.

FIG. 5 is a detail perspective view of the rod end showing a cap and rod attached.

FIG. 6 is a detail perspective view of the rod end showing the end crimped to form a rod.

Similar reference characters denote corresponding features consistently throughout the attached drawings.

DETAILED DESCRIPTION OF THE PREFERRED EMBODIMENTS

Figure 1:
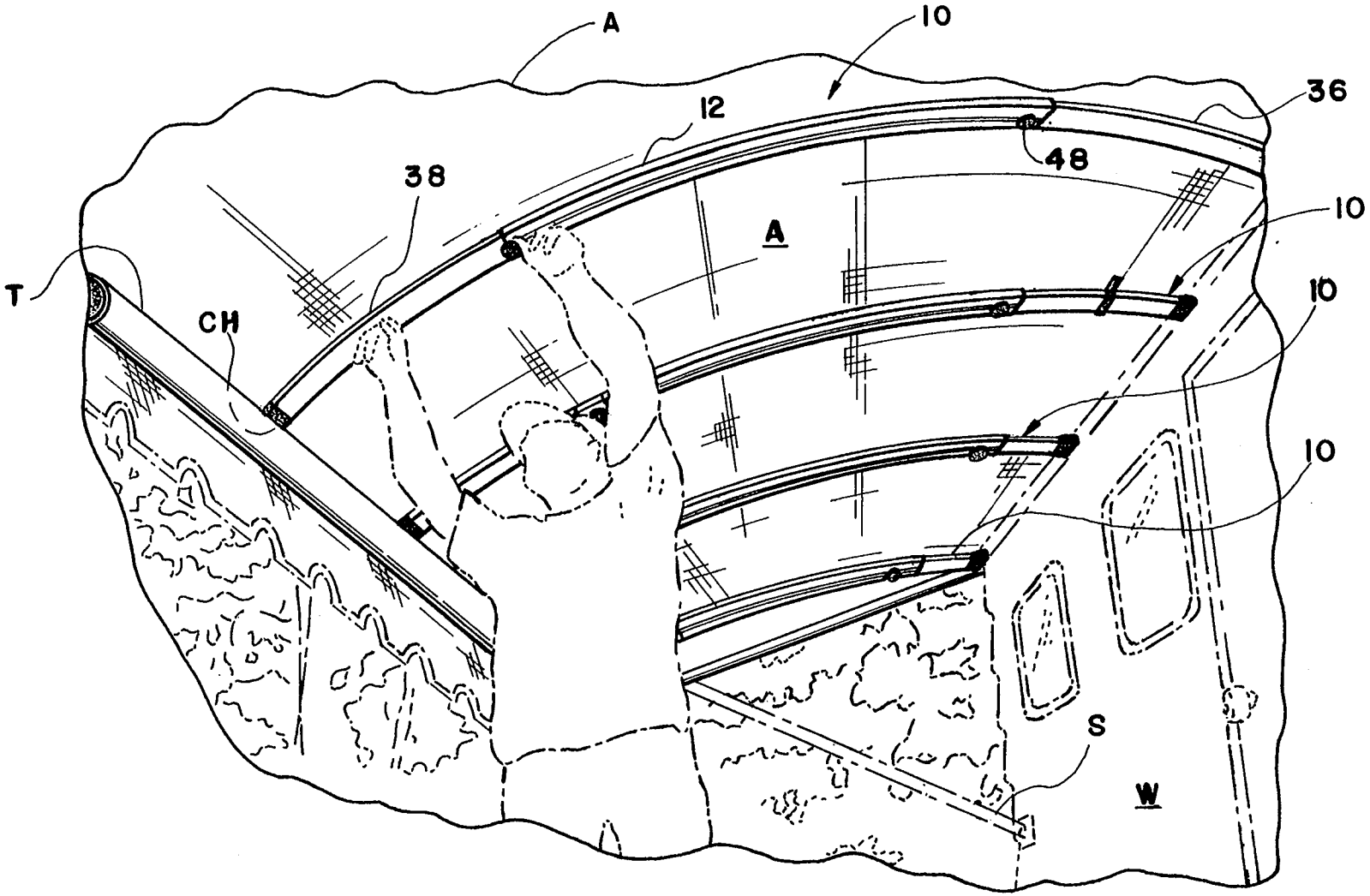
FIG. 1 is an environmental perspective view of the improved ribs of the present invention in use, disposed beneath the underside of an awning. A wall, roller tube, and bracing struts are also shown.
Figure 2:
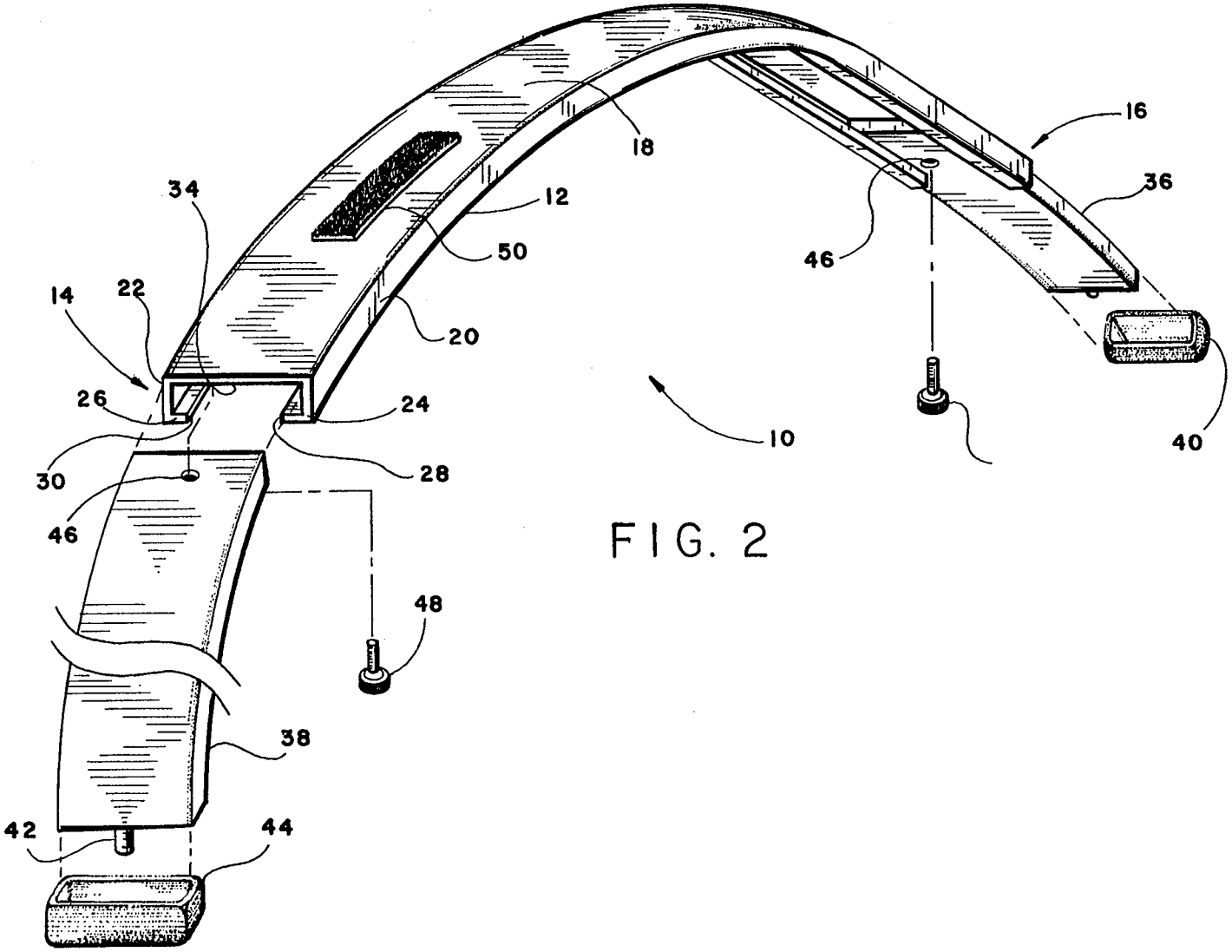
FIG. 2 is a exploded perspective view in partial section.

The present invention is shown in FIGS. 1 and 2. Four of the ribs 10 are shown disposed beneath the underside of the expanse of awning sheet material A. The awning A is supported in space by attachment to a wall W and a horizontal awning support tube T. The tube T will normally run parallel to the wall and be supported at one end by a strut S. Along with the wall the strut S forms a triangle. The other end of the tube T is held by an identical strut (not shown). The improved adjustable rib 10, as shown in FIG. 2, includes a curved elongated housing 12 made of a 5 foot section of C-Channel bowed by conventional means. The housing 12 includes a housing first end 14, a housing second end 16, a top wall 18, a right side wall 20, a left side wall 22, a right side flange 24, and a left side flange 26. The right side flange 24 and the left side flange 26 terminate to a right flange edge 28 and a left flange edge 30. The right flange edge 28 and the left edge flange edge 30 define an elongated longitudinal slot opposite the top wall 18. The top wall 18, left side wall 22, right side wall 20, right side flange 24, and left side flange 26 together define a slide element receiving aperture 34. The aperture 34 is dimensioned to accept a section of flat bar having a width of about 1¼ inch and a depth of about ¼ inch.

Two sections of bowed rigid flat bar 36,38, each about 30¾ inches in length and having a curvature identical to that of the housing 12, are inserted into each end of the housing 12 and slide within the slide element receiving aperture 34. The first section of flat bar 36 includes a plastic end cap 40 provided to enhance the frictional engagement of the end of flat bar 36 with the wall W. The second section of flat bar 38 includes a catch rod 42 dimensioned to engage a catch hole CH provided on the awning support tube T. A second plastic end cap 44 enhances frictional engagement between the second flat bar 38 and the tube T. Both end caps 40,44 have a length of about 1 inch.

The portion of the flat bars 36,38 within the housing 12 may be adjusted to vary the length the rib 10 for use with different sized awnings. In addition, the sliding configuration allows the flat bars 36,38 to be retracted within the housing 12 to leave only the caps 40,44 exposed, providing for convenient storage of the ribs 10 when not in use.

To fix the position of the flat bar 36,38 within the housing 12, a threaded hole 46 is tapped through each of the sections of flat bar 36,38. Each hole 46 is aligned with the slot to allow use of lock screws 48 to secure the flat bars 36,38. A lock screw 48 is threaded through a hole 46 until it engages the inner surface of the top wall 18 of the housing 12.

As shown in FIG. 2, a VELCRO (hook and loop fastener) patch 50 of one type (hook or loop) may be attached to the top wall 18 of the housing 12. A VELCRO patch of the other type (not shown) may be fastened to the awning A to contact the complementary patch 50 on the housing 12 and hold the rib 10 in place.

A second embodiment 100, as shown in FIGS. 3–6, includes a first hollow curved tube 102 having an outer cap end 104 and an inner end 106. A second hollow curved tube 108, with an inner end 110 and a rod end 112, has nearly the same curvature as the first tube 102, but a smaller diameter so as to allow the second tube inner end 110 to be telescopically fitted within the inner end 106 of the first tube 102. The outer cap end 104 is crimped and rolled over to accept a cap 140 having a rectangular cross section. A catch rod 142 extends from the rod end 112 of the second tube 108, and is dimensioned to engage a catch hole CH (see FIG. 1) provided on the awning support tube T. The catch rod 142 may be formed by welding a cap 144 with a rod 146 to the end of the tube 112 as shown in FIG. 5, or by crimping the end of the tube 112 as shown in FIG. 6. A conventional hose clamp 114 fastened to the inner end 106 of the first tube 102 is used to fix the position of second tube 108 within the first tube 102. A knob 116 is used to adjust the tightness of the hose clamp 114.

It is to be understood that the present invention is not limited to the embodiments described above, but encompasses any and all embodiments within the scope of the following claims.

We claim:

1. An improved adjustable rib for use with an awning support apparatus which in turn is used with an awning having one end attached to a wall and a second end attached to an awning support tube held a predetermined distance from said one end of the awning, measured along the awning, by a pair of side frames attached to the wall, said improved adjustable rib comprising;

a curved elongated housing having a housing first end and a housing second end, with a slide element receiving aperture extending therethrough;

an elongated curved first slide element, said first slide member having a first slide end, a first end cap provided at an opposite end, said first slide element having a cross section dimensioned to allow insertion of said first slide end through said housing first end and into said slide element receiving aperture of said elongated curved housing;

means for fixing the position of said first slide element within said curved elongated housing;

an elongated curved second slide element, said second slide member having a second slide end, a rod end opposite said second slide end, and a rod end cap for said rod end, said second slide member having a cross section dimensioned to allow insertion of said second slide end through said housing second end and into said slide element receiving aperture;

a catch rod extending from said rod end of said second slide bar member, said catch rod dimensioned to engage a catch hole provided on the awning support tube; and means for fixing the position of said second slide element within said curved elongated housing.

2. The improved adjustable rib according to claim 1, wherein said curved elongated housing is made from a section of C-channel having a top wall, said top wall having a left edge and a right edge, a right side wall extending downwardly from said right edge, a left side wall extending downwardly from said left edge, a right side flange extending horizontally from said right side wall towards said left wall to terminate in a right flange edge, and a left side flange extending horizontally from said left side wall towards said right wall to terminate in a left flange edge facing said right flange edge, said right flange edge and said left edge flange defining an elongated longitudinal slot opposite said top wall.

3. The improved adjustable rib according to claim 2, wherein said first slide element includes a threaded hole, said threaded hole being aligned with said elongated longitudinal slot of said curved elongated housing when said first slide end is inserted into said housing, said means for fixing the position of said first slide element within said curved elongated housing includes a first locking bolt threadably engaged in said threaded hole of said first slide element, said second slide element includes a threaded hole, said threaded hole being aligned with said elongated longitudinal slot of said curved elongated housing when said second slide end is inserted into said housing, and said means for fixing the position of said second slide element within said curved elongated housing including a second locking bolt threadably engaged in said threaded hole of said second slide element.

4. An improved adjustable rib for use with an awning support apparatus which in turn is used with an awning having one end attached to a wall and a second end attached to an awning support tube held a predetermined distance from said one end of the awning, measured along the awning, by a pair of side frames attached to the wall, said improved adjustable rib comprising;

a curved elongated housing having a housing first end and a housing second end, said curved elongated housing is made from a section of C-channel having a top wall, said top wall having a left edge and a right edge, a right side wall extending downwardly from said right edge, a left side wall extending downwardly from said left edge, a right side flange extending horizontally from said right side wall towards said left wall to terminate in a right flange edge, and a left side flange extending horizontally from said left side wall towards said right wall to terminate in a left flange edge facing said right flange edge, whereby said right flange edge and said left flange edge define an elongated longitudinal slot opposite said top wall, and whereby said top wall, left side wall, right side wall, right side flange, left side flange, define a slide element receiving aperture;

an elongated curved first slide element, said first slide member having a first slide end, a first end cap provided at an opposite end, said first slide element having a cross section dimensioned to allow insertion of said first slide end through said housing first end and into said slide element receiving aperture, and a first threaded hole, whereby said first threaded hole is aligned with said elongated longitudinal slot of said curved elongated housing when said first slide member is inserted into said elongated curved housing;

means for fixing the position of said first slide element within said curved elongated housing, said means for fixing position of said first slide element within said curved elongated housing includes a first locking bolt threadably engaged in said first threaded hole of said first slide element;

an elongated second slide element, said second slide member having a second slide end, a rod end opposite said second slide end, and a rod end cap for said rod end, said second slide bar member having a cross section dimensioned to allow insertion of said second slide end through said housing second end and into said slide element receiving aperture, and a second threaded hole, whereby said second threaded hole is aligned with said elongated longitudinal slot of said curved elongated housing when said second slide member is inserted into said elongated curved housing;

a catch rod connected to and extending from said rod end of said second slide bar member, said rod dimensioned to engage a catch hole provided on the awning support tube; and means for fixing position of said second slide element within said curved elongated housing, said means for fixing position of said second slide element within said curved elongated housing includes a second locking bolt threadably engaged in said second threaded hole of said second slide element.

5. An improved adjustable rib for use with an awning support apparatus which in turn is used with an awning having one end attached to a wall and a second end attached to an awning support tube held a predetermined distance from said one end of the awning, measured along the awning, by a pair of side frames attached to the wall, said improved adjustable rib comprising;

a first hollow curved tube, said first tube having an outer cap end and an inner end, said outer cap end crimped and rolled over to accept a cap having a rectangular cross section;

a second hollow curved tube, said second tube having a second tube inner end and a rod end, said second tube having nearly the same curvature as said first tube but a smaller diameter than said first tube so as to allow said second tube inner end to be telescopically fitted within said inner end of said first tube;

a catch rod connected to and extending from said rod end of said second tube, said catch rod dimensioned to engage a catch hole provided on the awning support tube; and means for fixing the position of said second tube within said first tube.

6. The improved adjustable rib according to claim 5, wherein said means for fixing the position of said second tube within said first tube includes a hose clamp attached to said inner end of said first tube, whereby said hose clamp is tighten against said first tube to compress said first tube against said second tube.

* * * * *